US007905501B2

(12) United States Patent
Landry

(10) Patent No.: US 7,905,501 B2
(45) Date of Patent: Mar. 15, 2011

(54) ASSEMBLY AND FRAME FOR BLADING BOOT

(76) Inventor: Sylvain Landry, Lasalle (CA)

( * ) Notice: Subject to any disclaimer, the term of this patent is extended or adjusted under 35 U.S.C. 154(b) by 637 days.

(21) Appl. No.: 11/902,970

(22) Filed: Sep. 27, 2007

(65) Prior Publication Data

US 2009/0085313 A1 Apr. 2, 2009

(51) Int. Cl.
*A63C 1/36* (2006.01)

(52) U.S. Cl. ..... 280/11.14; 280/11.18

(58) Field of Classification Search ..... 280/7.12, 280/7.13, 7.14, 11.14, 11.18, 11.19, 11.223, 280/11.27, 11.28
See application file for complete search history.

(56) References Cited

U.S. PATENT DOCUMENTS 3,292,940 A * 12/1966 Weitzner ..... 280/7.13
4,382,605 A * 5/1983 Hegna ..... 280/11.225
5,524,912 A 6/1996 Laub et al.
5,709,396 A * 1/1998 Zorzi et al. ..... 280/11.28
5,906,380 A * 5/1999 Searby et al. ..... 280/7.13
5,918,889 A * 7/1999 Tai ..... 280/11.225
6,029,984 A * 2/2000 Pivotto ..... 280/11.28
6,068,268 A 5/2000 Cornelius et al.
6,270,089 B1 8/2001 Marechal
6,276,695 B1 * 8/2001 Foffano et al. ..... 280/11.221
6,311,990 B1 11/2001 Landry
6,568,710 B2 * 5/2003 Kim ..... 280/809
6,581,943 B2 * 6/2003 Wegener ..... 280/11.221
6,932,361 B2 8/2005 Steinhauser, Jr.
7,374,209 B2 * 5/2008 von Detten ..... 280/841
2005/0212226 A1 9/2005 Landry
2007/0096408 A1 5/2007 Yang

* cited by examiner

*Primary Examiner* — Frank B Vanaman
(74) *Attorney, Agent, or Firm* — Equinox Protection; Franz Bonsang, Patent Agent

(57) ABSTRACT

A blade insert assembly and frame therefor for a blading boot are securable on a base of the frame to a sole of the blading boot for ice-skating. The blade insert assembly accommodates two blade elements in tandem, each blade element being secured via an insert adjustment mechanism and a mounting pin to the frame.

16 Claims, 4 Drawing Sheets

ASSEMBLY AND FRAME FOR BLADING BOOT

FIELD OF THE INVENTION

The present invention relates to a blading boot and more particularly has reference to a blade insert assembly and frame for a blading boot that enables fitting of the blading boot with either wheels or blades in the frame for enabling use of the blading boot as a roller blading boot or as an ice skating boot.

The present invention is also concerned with the provision of an insert assembly and frame for a blading boot that are suitable for use in display acrobatics.

BACKGROUND OF THE INVENTION

It is well known in the art to provide a blading boot possessing interchangeable frames, assemblies, mountings, or the like for enabling the boot to be deployed in a number of different skating environments. For example, U.S. Pat. No. 5,534,912 to Laub et al discloses such a boot providing for its use for roller blading, ice-skating, or skiing, the boot being formed with suitable trucks adapted for those uses. Similarly, U.S. Pat. No. 6,270,089 to Marechal describes a boot assembly having spaced apart mountings on its sole for the reception of specially designed mounts for different trucks. US Patent Application No. 2007/0096408 to Yang also provides for a multi-functional boot with interchangeable blades for roller-skating, ice skating or skiing.

My earlier U.S. Pat. No. 6,311,990 describes an ice skateboard provided with blade runners spaced apart on trucks secured to the base of the board. Cornelius discloses in his U.S. Pat. No. 6,068,268 an in-line roller blading boot having two pairs of in-line rollers mounted on a truck, the forward pair being spaced from the rearward pair to provide a gap which may be used for acrobatic manoeuvres, such as sliding across raised, surfaces, or sliding down rails for example. The gap provides a bearing surface with which the rail for example engages to allow the blader to slide therealong without the rollers impeding travel.

Currently there appears not to be available a blading boot for ice-skating which would facilitate acrobatic manoeuvres of this kind.

Accordingly, there is a need for a blade insert assembly and frame for a blading boot that has a simple configuration enabling ice-skating acrobatics of the 'extreme' kind mentioned in relation to the prior art.

In this specification, the term 'blader' is used to indicate a skater using the blading boot.

SUMMARY OF THE INVENTION

It is therefore a general object of the present invention to provide an improved assembly and frame for mounting of blades in a blading boot.

A more specific object of the invention is to provide a blade insert assembly and frame for an ice-skating boot with the capability of use by a blader for extreme skating involving acrobatics.

A further object of the present invention is to provide such a blade insert assembly possessing a safety feature for maintaining blade alignment.

A still further object of the present invention is to provide a general-purpose assembly and frame which the ice-skating blade may be exchanged for a roller blade.

According to a first aspect of the invention, there is provided a blade insert assembly mounting of respective ice skating blading elements in a frame having a base securable to a sole of an in-line blading boot, downwardly depending webs defining a space occupied by spaced apart bosses defining zones for the frame, the webs being relieved centrally of the zones to provide arches, the blade insert assembly comprising:

- two parts, each part being securable in the zones and having formations for registration with the zones, when the parts are secured therein, and a slot for accommodating and securing one respective ice skating blade element thereto for mounting and securing said in-line ice skating elements, when the frame is secured to the sole, spaced apart in tandem longitudinally of the sole; and
- an adjustment mechanism connecting to at least one said part and provided for a corresponding one of the blade elements, the adjustment mechanism enabling in use lateral adjustment of the corresponding blade element to ensure correct alignment with the other blade element.

According to another aspect of the invention, there is provided a frame for an in-line blading boot, the frame comprising:

- a base securable to a sole of an in-line blading boot,
- downwardly depending webs defining a space occupied by spaced apart bosses defining zones for the frame, the webs being relieved centrally of the zones to provide arches; and
- a blade insert assembly having:
  - two parts, each part being securable in the zones and having formations for registration with the zones, when the parts are secured therein, and a slot for accommodating and securing one respective ice skating blade element thereto for mounting and securing said in-line ice skating elements, when the frame is secured to the sole, spaced apart in tandem longitudinally of the sole; and
  - and an adjustment mechanism connecting to at least one said part and provided for a corresponding one of the blade elements, the adjustment mechanism enabling in use lateral adjustment of the corresponding blade element to ensure correct alignment with the other blade element.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
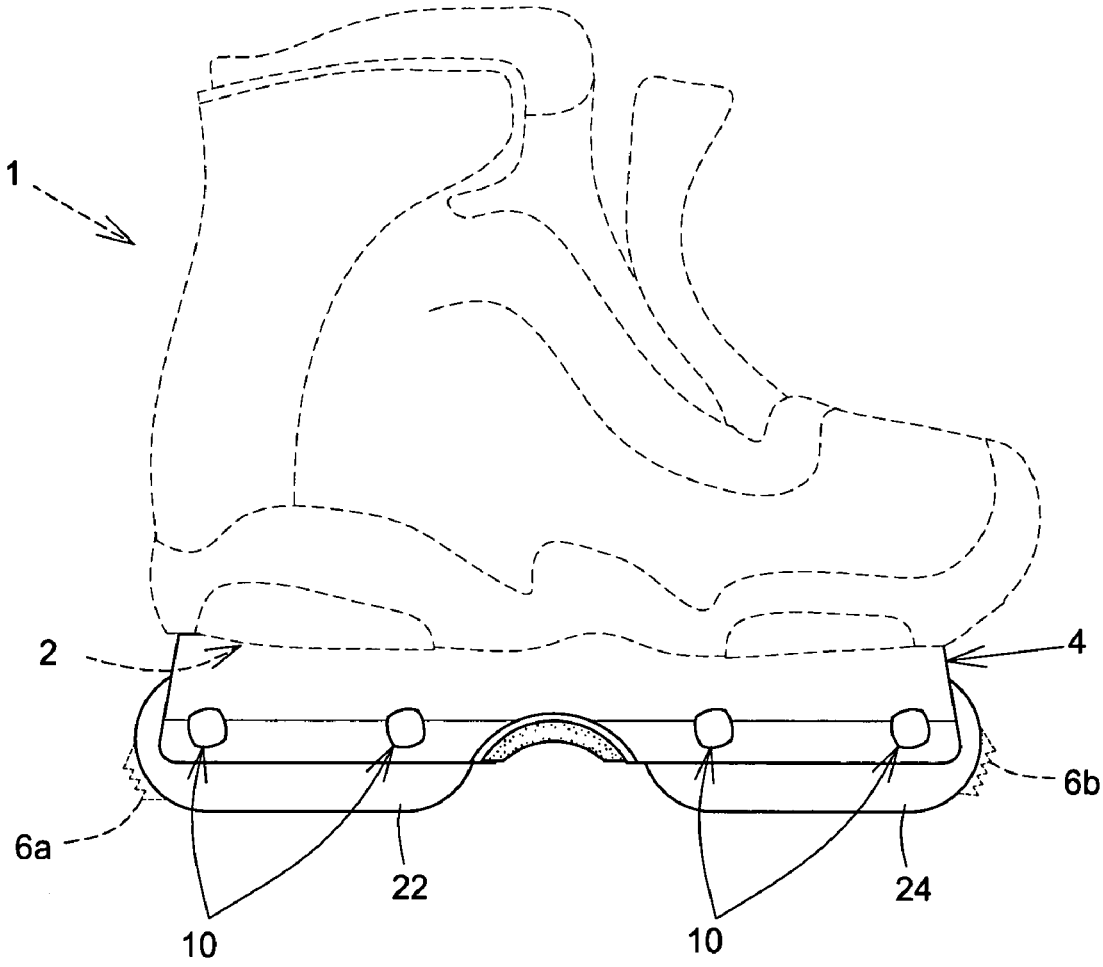
FIG. 1 is a side elevation of a blading boot having a blade insert assembly and frame in accordance with an embodiment of the present invention installed thereupon.

Referring to FIG. 1, there is shown a blading boot 1, notably an ice-skating boot, having a frame, shown generally as 4, in accordance with the present invention installed thereupon.

The boot 1 has a sole 2 upon which the frame 4 is installed, with the frame 4 accommodating two blade elements 22, 24. Each blade element 22, 24 is secured to the frame 4 through the agency of adjustment means 10. The blade elements 22, 24 are provided at their leading and trailing edges with a set of teeth 6*a*, 6*b* respectively. The frame 4 is secured to the sole 2 of the boot 1 by suitable fasteners (not shown) extending through the frame 4 as at 3.

Figure 2:
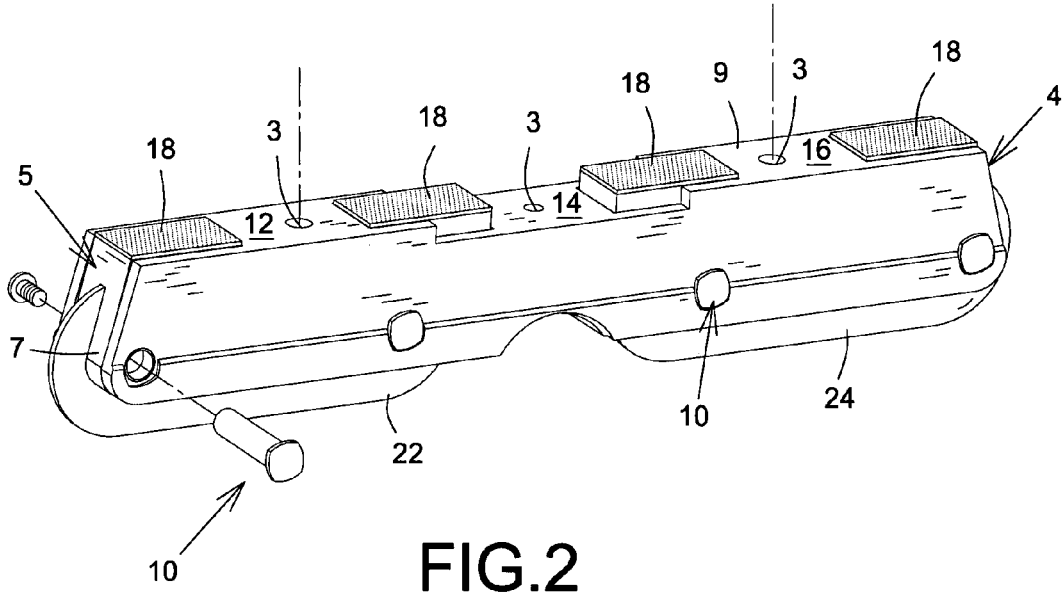
FIG. 2 is a side perspective view of a the blade insert assembly and frame shown in FIG. 1.

FIG. 2 shows the frame 4 in unitary form with a blade insert assembly therefore, shown generally as 5, of the present invention. The blade insert assembly 5 has two parts 7, 9 registering positively with the underside of the frame 4 which is provided with three bosses 12, 14, 16 defining four separate zones 17 between two side webs 11. The side webs 11 are relieved at their longitudinal centers to provide arches 11*a* to provide bearing surfaces for use in the acrobatic usage of the boot 1.

Complementary formations 13, 15 on each part 7, 9 project into the zones 17 upon assembly of the blade insert assembly 5 in the frame 4, typically by inserted mounting of the assembly 5 therein. A pad 18 of resilient shock-absorbing material is interposed between the formations 13, 15 of each part 7, 9 of the blade insert assembly 5 and the sole 2 of the boot 1. Each part 7, 9 of the blade insert assembly 5 is provided with a slot 20 for the reception of a blade element 22, 24, respectively, each element being formed with through fixing holes 23, 25 for registration with corresponding holes 26, 28 in each of the parts 7, 9. In turn, the frame 4 is provided with two pairs of fixing holes 27, 29.

Figure 4:
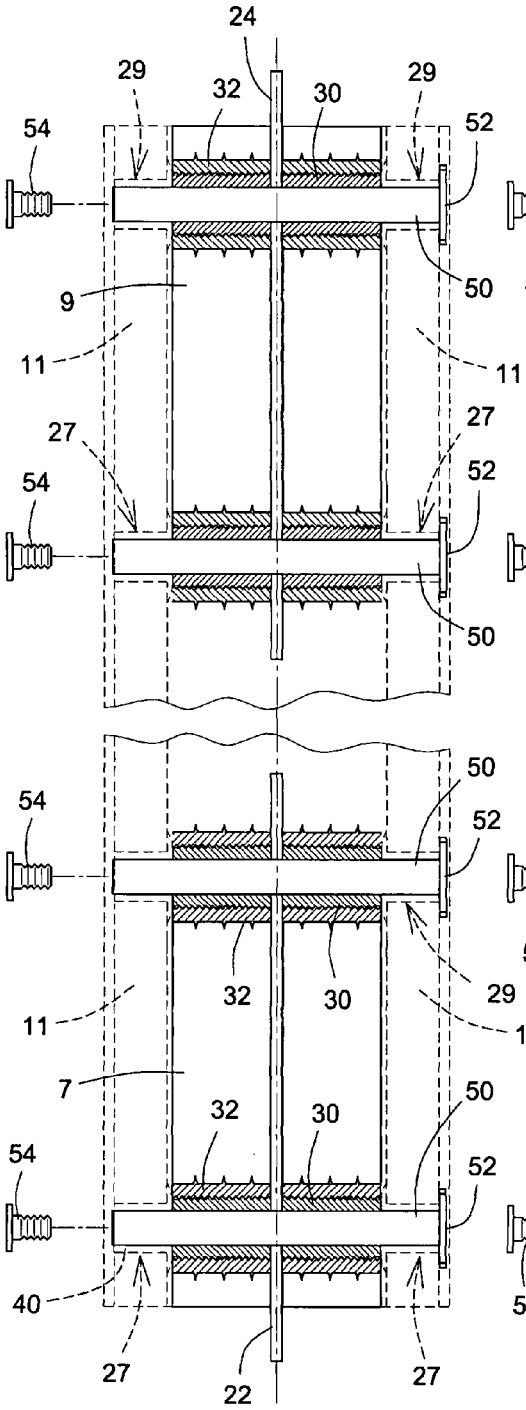
FIG. 4 is a plan view on the line 4-4 in FIG. 3 showing the blade elements of the blade insert assembly in alignment.
Figure 4A:
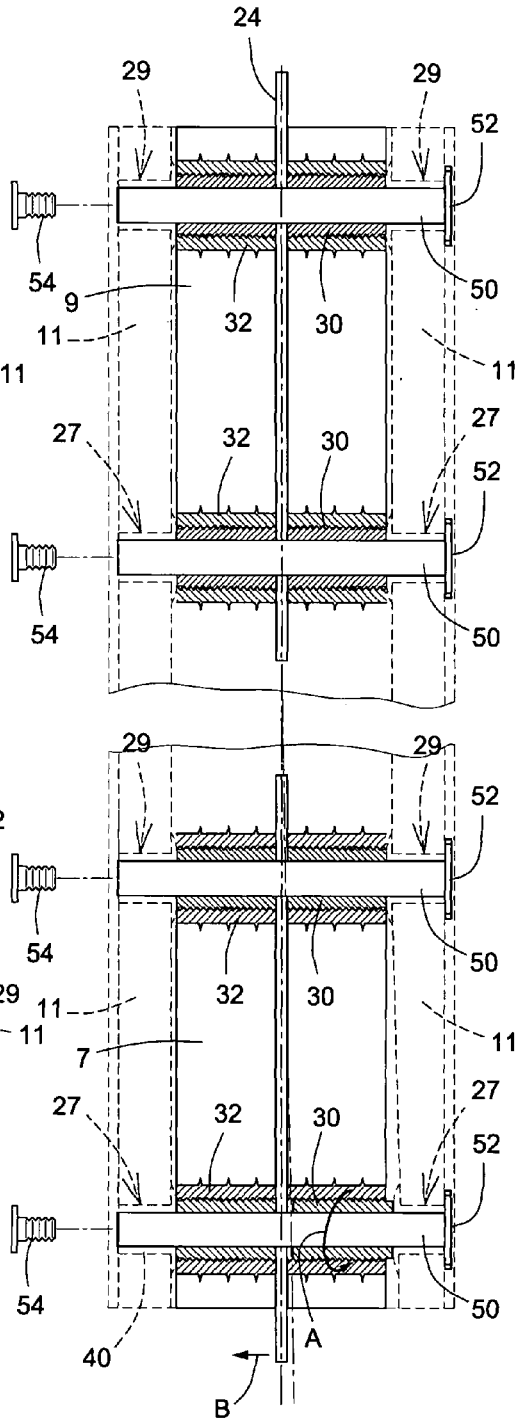
FIG. 4*a* is a plan view similar to FIG. 4 showing the blade elements of the blade insert assembly kept in alignment using an insert alignment mechanism.

In each one of the holes 26, 28 there are located spacers 30, 32, namely an internal spacer 30 and an external spacer 32. The external spacer 32 is threaded internally and the internal spacer 30 is externally threaded as shown in FIGS. 4 and 4*a*, through the agency of which interengagement the spacers 30, 32 are kept together to form an insert adjustment mechanism. The external spacer 32 is fixed in any convenient manner within the parts 7, 9 of the blade insert assembly 5 either side of the slot 20 and matches the lateral extent of the parts 7, 9, as shown, as does the internal spacer 30. The internal spacer 30 is provided at its relatively outer margin with diametrically opposed notches 30' for the reception of an adjustment tool, for example a screwdriver (not shown). A bushing 40 is provided in each of the fixing holes 27, 29 in the webs 11 of the frame 4 and is provided with a mushroom head 42.

A mounting pin 50 is provided and in use extends through the webs 11 of the frame 4, the internal spacers 30 and the holes 23, 25 in the blade elements 22, 24 to hold the elements to the blade insert assembly 5 and thus to the frame and ultimately to the boot via its sole. The mounting pin 50 is provided with a head 52, which in one position rests in a recess 60 provided on the outer side of the web 11. The pin 50 is threaded internally at its end remote from the head 52 for the reception in use of a locking screw 54, which may similarly rest within a recess (not shown) on the outside of the web 11.

Thus in the assembled condition the frame 4 and the blade insert assembly 5 with the blade elements 22, 24 are held together by the adjustment mechanism and the mounting pins 50 extending through these integers and locked in place by the interengagement of the spacers 30, 32 and the tightened locking screws 54.

In FIG. 4, the blade elements 22, 24 are aligned longitudinally along the centre-line of the boot 1. However, as shown in FIG. 4*a* one of the elements 22 is misaligned with respect to the other 24 and to the centre-line of the boot 1 and accordingly adjustment becomes necessary in order to ensure proper skating performance and safety. In order to effect adjustment, the locking screw 54 is slackened or removed and the pin 50 is removed for access to the relevant internal spacer 30. The spacer 30 is turned, for example by the use of a screwdriver engaging the notches 30', in an appropriate direction as shown by arrow A in order to effect relative axial movement between the spacers 30, 32. Once adjustment has been completed, the mounting pin 50 is reinserted and the tightening screw 54 is retightened. If misalignment of the blade elements occurs elsewhere, appropriate adjustment is made locally by the use of the internal spacer 30 nearest to the misalignment.

Figure 2A:
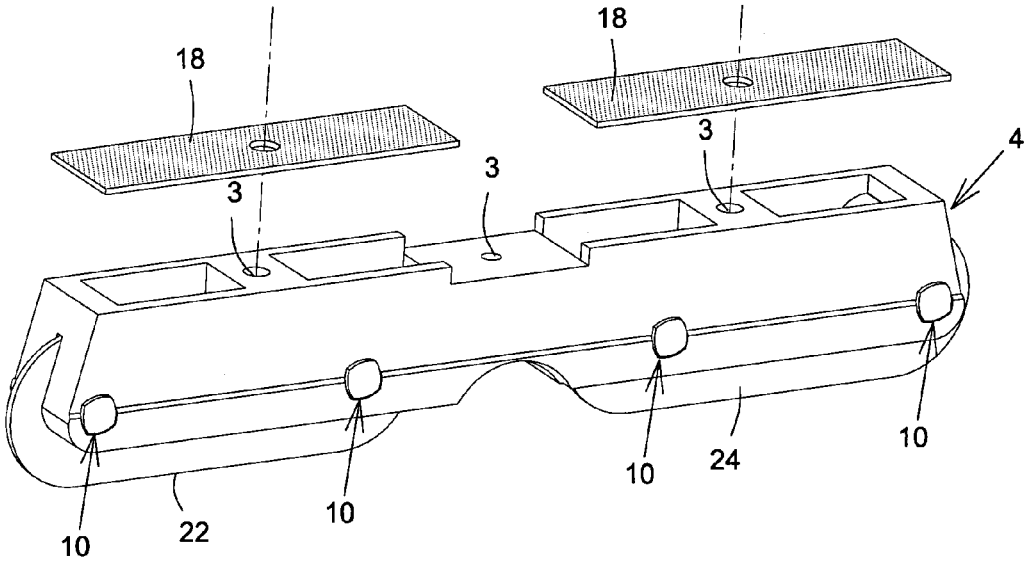
FIG. 2*a* is a side perspective view of an alternative embodiment of the blade insert assembly and frame shown in FIG. 2.
Figure 3:
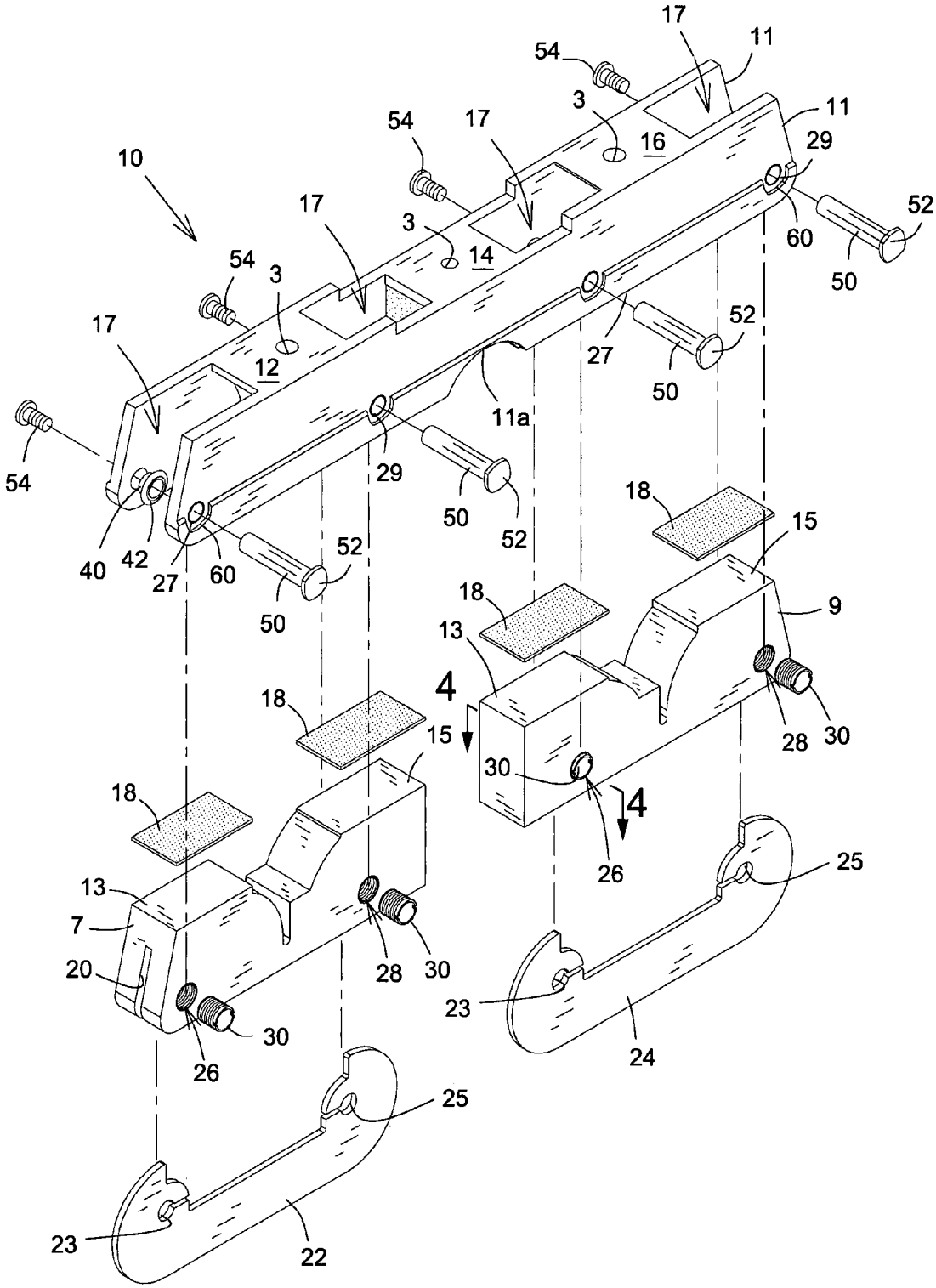
FIG. 3 is an exploded view of the blade insert assembly and frame shown in FIG. 2.

FIG. 2*a* shows a frame 4 in the absence of a blade insert assembly 5 since the blading boot 1 has been custom built for ice-skating only and the frame is of unitary construction, the blade elements being accommodated directly in a slot 20 formed centrally and longitudinally of the frame. In all other respects, the adjustment means are the same and function in the same way as those described above in relation to the other figures.

The provision of the arches 11*a* in the side webs of the frame between the two blade elements 22, 24 enables use of the boot 1 in acrobatic or extreme skiing in which the blader jumps for example onto a rail, either horizontal or downwardly inclined, to slide down it to land on to ice to skate further. The blader seeks to ensure that the arches locate on the rail to provide a reasonably positive slideway.

The present invention thus provides a blading boot for ice-skating in an extreme manner, but with the added and useful feature of being able to correct the alignment of the two blades held in tandem in the frame. The manner of adjustment is relatively simple and swift.

It is to be understood that the blading boot of FIG. 2 could be used for interchangeability into a roller blading boot with the pins 50 becoming the roller pins of the rollers, which are accommodated in the zones 17 of the frame 4.

While a specific embodiment has been described, those skilled in the art will recognize many alterations that could be made within the spirit of the invention, which is defined solely according to the following claims.

I claim:

1. A blade insert assembly mounting of respective ice skating blading elements in a frame having a base securable to a sole of an in-line blading boot, downwardly depending webs defining a space occupied by spaced apart bosses defining zones for the frame, the webs being relieved centrally of the zones to provide arches, the blade insert assembly comprising:

two parts, each part being securable in the zones and having formations for registration with the zones, when the parts are secured therein, and a slot for accommodating and securing one respective ice skating blade element thereto for mounting and securing, when the frame is secured to the sole, said in-line ice skating elements longitudinally spaced apart one behind another longitudinally along the sole; and an adjustment mechanism connecting to at least one said part and provided for a corresponding one of the blade elements, the adjustment mechanism enabling in use lateral adjustment of the corresponding blade element to ensure correct alignment with the other blade element, wherein each part, the blade elements, and the webs are provided with fixing holes and the adjustment mechanism is located within the fixing holes.

2. The blade insert assembly of claim 1, wherein the blade elements are replaceable.

3. The blade insert assembly of claim 1, wherein impact-absorbing pads are provided intermediate the frame and the sole of the boot.

4. The blade insert assembly of claim 1, wherein a leading edge of the blade element at a toe of the boot has a number of teeth formed thereon.

5. The blade insert assembly of claim 1, wherein a trailing edge of the blade element at a heel of the boot has a number of teeth.

6. The blade insert assembly of claim 1, wherein the adjustment mechanism includes for each fixing hole an internal spacer provided with an external thread, an external spacer provided with an internal thread, the external and internal threads interengaging, the external spacer being secured within the blade insert assembly, and a mounting pin in use extending through the fixing holes with the spacers being disposed on either side of the respective blade element, and the inner spacer being actuable in an axial direction and adapted thereby to correct any misalignment of one blade element relative to the other.

7. The blade insert assembly of claim 6, wherein the spacers are of cylindrical form.

8. The blade insert assembly of claim 6, wherein a locking screw is provided for locking the mounting pin in position.

9. A frame for an in-line blading boot, the frame comprising:

a base securable to a sole of an in-line blading boot, downwardly depending webs defining a space occupied by spaced apart bosses defining zones for the frame, the webs being relieved centrally of the zones to provide arches; and a blade insert assembly having:

two parts, each part being securable in the zones and having formations for registration with the zones, when the parts are secured therein, and a slot for accommodating and securing one respective ice skating blade element thereto for mounting and securing, when the frame is secured to the sole, said in-line ice skating elements longitudinally spaced apart one behind another longitudinally along the sole; and an adjustment mechanism connecting to at least one said part and provided for a corresponding one of the blade elements, the adjustment mechanism enabling in use lateral adjustment of the corresponding blade element to ensure correct alignment with the other blade element, wherein each part, the blade elements, and the webs are provided with fixing holes and said adjustment mechanism is located within said fixing holes.

10. The frame of claim 9, wherein the blade elements are replaceable.

11. The frame of claim 9, wherein impact-absorbing pads are provided intermediate the frame and the sole of the boot.

12. The frame of claim 9, wherein a leading edge of the blade element at a toe of the boot has a number of teeth formed thereon.

13. The frame of claim 9, wherein a trailing edge of the blade element at a heel of the boot has a number of teeth.

14. The frame of claim 9, wherein the adjustment mechanism includes for each fixing hole an internal spacer provided with an external thread, an external spacer provided with an internal thread, the external and internal threads interengaging, the external spacer being secured within the blade insert assembly, and a mounting pin in use extending through the fixing holes with the spacers being disposed on either side of the respective blade element, and the inner spacer being actuable in an axial direction and adapted thereby to correct any misalignment of one blade element relative to the other.

15. The frame of claim 14, wherein the spacers are of cylindrical form.

16. The frame of claim 14, wherein a locking screw is provided for locking the mounting pin in position.

* * * * *